United States Patent [19]

Berntell

[11] 4,422,291

[45] Dec. 27, 1983

[54] HOT GAS ENGINE HEATER HEAD

[75] Inventor: John O. Berntell, Staffanstorp, Sweden

[73] Assignee: Mechanical Technology Incorporated, Latham, N.Y.

[21] Appl. No.: 308,249

[22] Filed: Oct. 5, 1981

[51] Int. Cl.[3] ..... F02G 1/04

[52] U.S. Cl. ..... 60/517; 60/526

[58] Field of Search ..... 60/525, 526, 517

[56] References Cited

U.S. PATENT DOCUMENTS 3,808,815 5/1974 Friedemann ..... 60/517

3,940,934 3/1976 Hakansson ..... 60/526 X 4,069,671 1/1978 Berntell ..... 60/526 X

*Primary Examiner*—Allen M. Ostrager

*Attorney, Agent, or Firm*—Joseph V. Claeys; Arthur N. Trausch, III

[57] ABSTRACT

A heater head for a multi-cylinder double acting hot gas engine in which each cylinder is surrounded by an annular regenerator unit, and in which the tops of each cylinder and its surrounding regenerator are interconnected by a multiplicity of heater tubes. A manifold for the heater tubes has a centrally disposed duct connected to the top of the cylinder and surrounded by a wider duct connecting the other ends of the heater tubes with the regenerator unit.

7 Claims, 7 Drawing Figures

HOT GAS ENGINE HEATER HEAD

The Government of the United States of America has rights in this invention pursuant to Contract No. DEN3-32 awarded by the U.S. Department of Energy.

FIELD OF THE INVENTION

This invention relates to a hot gas engine heater head adapted to guide and heat an oscillating flow of gaseous working medium between a cylinder top and a space containing a regenerator surrounding said cylinder top.

DESCRIPTION OF THE PRIOR ART

In the past, the heater heads of hot gas engines have included a number of tubes, each being connected at one end to a first manifold providing entrance to the cylinder top, and connected at the other end to a second manifold providing entrance to the regenerator canister. The said manifolds may have been arcuately shaped and—in case of multi cylinder engines—they may have been juxtaposed to form concentric circles horizontally arranged in a combustion chamber symmetrically designed around a vertical axis. A heater head of this type has been described and shown in the UK Patent Specification No. 2,040,003A, said specification corresponding to U.S. Pat. No. 4,261,173.

In the known heater heads the manifolds have been designed as integral parts of the cylinder tops or of the upper parts of the regenerator canisters. The manufacture of heater heads involves the problems of joining the heater tubes to the manifolds, the problem of manufacturing the manifolds, and the problems of dealing with materials capable of withstanding thermal stresses in cylinders, regenerator canisters, manifolds and heater tubes.

SUMMARY OF THE INVENTION

Accordingly, the objects of the present invention are to provide a hot gas engine heater head having a configuration which simplifies the manufacturing of manifolds and the joining of heater tubes to the manifold, and which the present invention makes it possible to use separate materials in the components exposed to thermal stresses with a minimum of problems in connection with the necessary joints.

These objects are attained by the invention in that the connection between the first manifold and the cylinder top is a single duct surrounded by an annular duct which connects said second manifold with said regenerator connecting space.

BRIEF DESCRIPTION OF THE DRAWINGS

The invention along with its many attendant objects and advantages, will become better understood upon reading the following detailed description of the preferred embodiment in conjunction with the following drawings, wherein.

DETAILED DESCRIPTION OF THE PREFERRED EMBODIMENT

Figure 1:
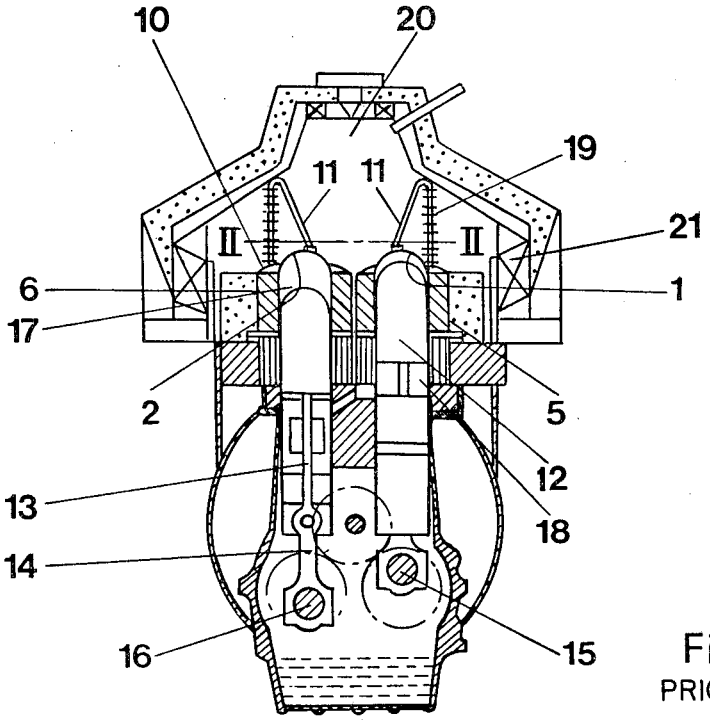
Fig. 1 PRIOR ART
FIG. 1 shows schematically a vertical section through a hot gas engine provided with a heater head of conventional design.
Figure 2:
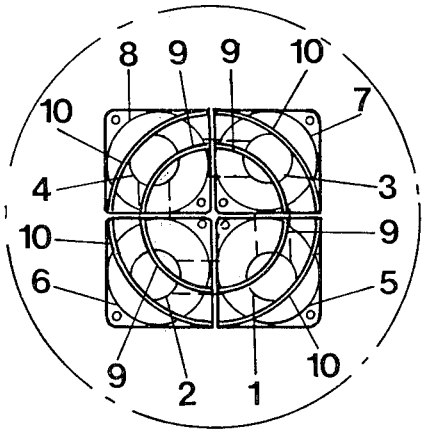
Fig. 2 PRIOR ART
FIG. 2 is a section along the line II—II in FIG. 1.

Referring first to FIGS. 1 and 2, a known type of double acting hot gas engine is shown including a main body portion having bored therein four cylinders 1–4 in square formation. The four cylinders 1–4 are each surrounded by one of four annular regenerators units 5–8. The tops of the cylinders 1–4 are provided with individual arcuately shaped cylinder manifolds 9 which form a circle in their relative positions shown in FIG. 2. The tops of the regenerator units are provided with individual regenerator manifolds 10 which form a circle of greater diameter than the circle formed by the cylinder manifolds 9.

The pairs of cylinder manifolds 9 and regenerator manifolds 10 thus formed are interconnected by tubes 11 which extend between the cylinder and regenerator manifolds.

Each cylinder 1–4 has a piston 12 and attached piston rod 13 mounted for reciprocating therein. The piston rod 13 is secured to a connecting rod 14 which is journaled to a crank on one of a pair of parallel crankshafts 15 and 16 of a conventional drive mechanism. Each piston 12 separates its cylinder into a high temperature, variable volume chamber 17 and a low temperature, variable volume chamber 18. The tubes 11 which are partly provided with fins 19 extend into a combustion chamber 20 for absorbing heat. The engine also includes a preheater 21 for preheating combustion air by exchanging heat with exhaust gases.

As shown in FIG. 2 the cylinder manifold 9, the regenerator manifold 10 and the connecting tubes 11 for each of the cylinders 1–4 and its respective regenerator housing form separate units. The heater head in FIG. 2 is composed of four identical separate units.

For reasons of manufacture it may be advantageous to design each unit as an assembly of separate elements, viz. a cylinder, a regenerator housing, manifolds and tubes, and then join these elements together in a suitable way. It may even be advantageous to reduce costs by using different materials in the different elements. However, due to the complexity and great number of the joints it is difficult to avoid leakages of the working gas used in the engine.

Figure 3:
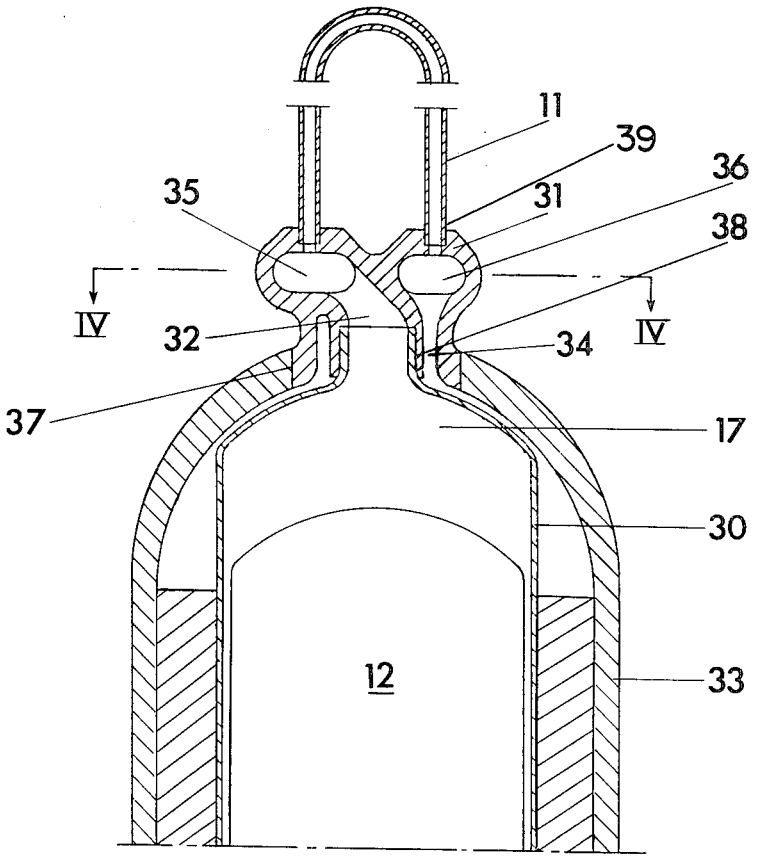
FIG. 3 is a vertical section through a part of a heater head according to the invention, the section following the line III—III in FIG. 4.
Figure 4:
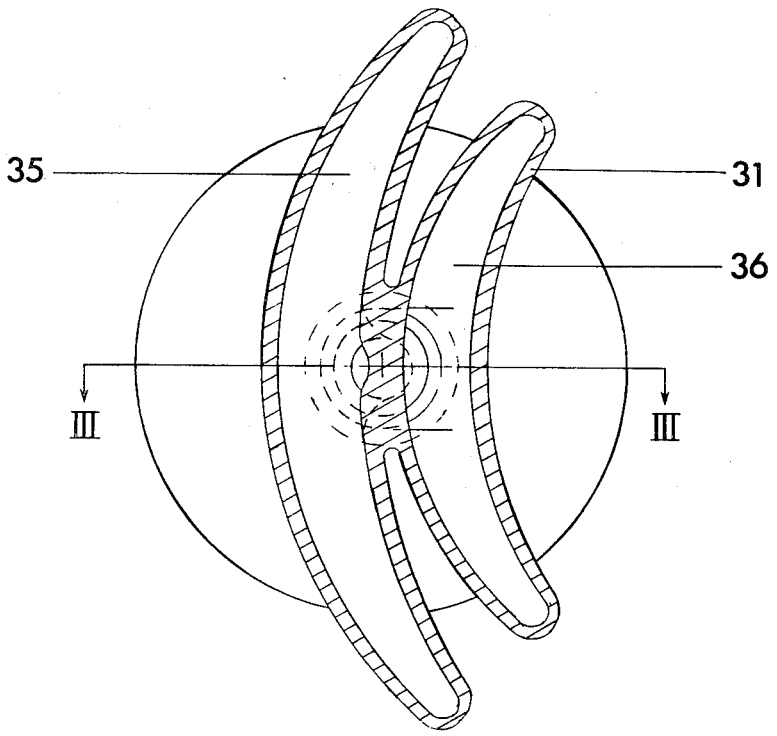
FIG. 4 is a section along the line IV—IV in FIG. 3.

FIGS. 3 and 4 show an embodiment of the invention on a larger scale than that of the corresponding parts shown in FIGS. 1 and 2.

As shown in FIG. 3 a cylinder 30 made of, e.g. a ceramic material such as silicon nitride is connected to a manifold housing 31 made of a precision cast, heat resistent stainless steel or a ceramic material. The manifold housing 31 has a central downwardly directed duct 32 communicating with the upper variable volume chamber 17 in the cylinder 30 above the piston 12. The cylinder 30 is surrounded by a regenerator housing 33, which also could be made of a ceramic. The manifold housing 31 is brazed to the regenerator housing 33 and provides a duct 34 having annular cross section surrounding the central duct 32 to the cylinder. The manifold housing 31 is made as a single unit, but acts as a manifold 35 to the cylinder 30 as well as a manifold 36 to the regenerator housing 33. Tubes 11 are connected to the manifold housing 31 by brazing and correspond to the tubes 11 of the heater head shown in FIGS. 1 and 2.

It will be understood that the only joints exposed to maximum gas pressure are joints 37 between the regenerator housing 33 and the housing 31 and joints 39 between the tubes 11 and the housing 31. The joints 39 are small and thus not exposed to substantial forces. The joint 37 is comparatively short and may easily be inspected after manufacture. The joint 38 between the cylinder 30 and the housing 31 is only exposed to the differences in the working gas pressure and any leakage here will not cause a loss of gas. Thus the joint 38 need not be brazed.

Figure 5:
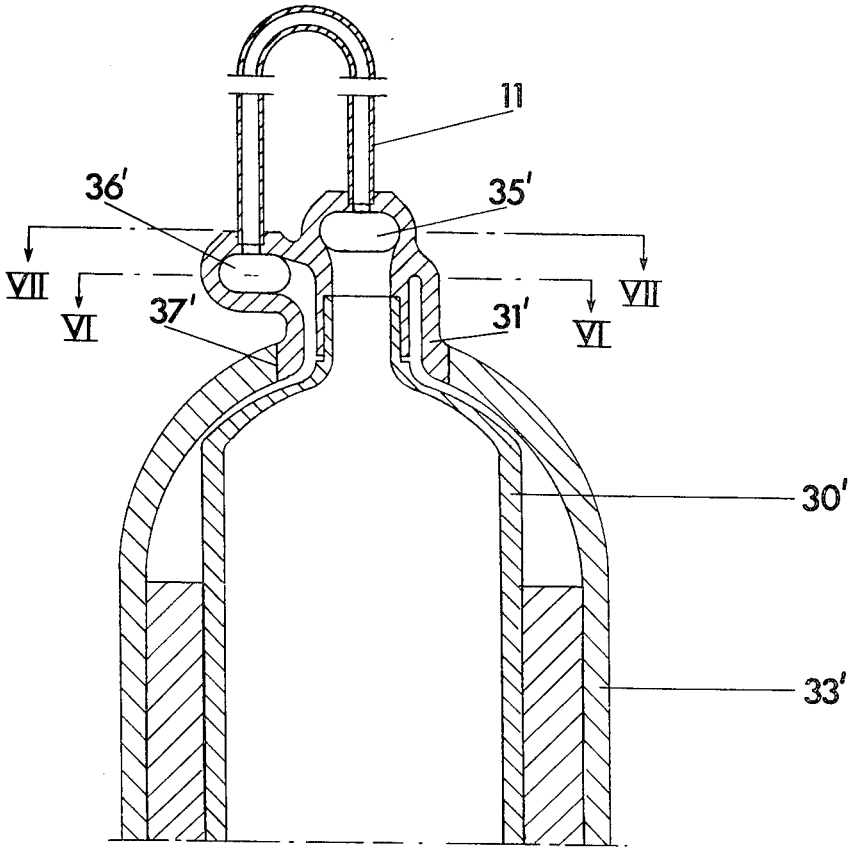
FIG. 5 is a vertical section through a second embodiment of a heater head according to the invention.
Figure 6:
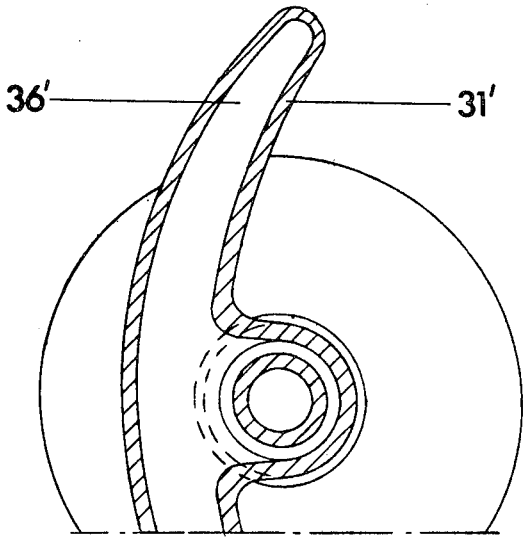
FIG. 6 is a section along the line VI—VI in FIG. 5.
Figure 7:
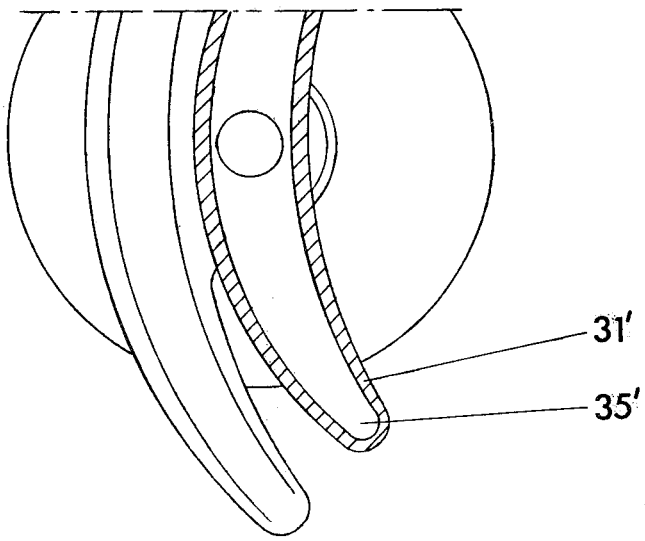
FIG. 7 is a section along the line VII—VII in FIG. 5.

FIGS. 5, 6 and 7 show another embodiment of a heater head unit according to the invention. The primed reference numerals used correspond to the unprimed numerals used for corresponding elements shown in FIGS. 3 and 4. The embodiment of FIGS. 5, 6 and 7 could be used in case it is desired to arrange the heater tubes 11 at larger diameters. In order to obtain short ducts and small dead volumes the manifold 36' to the regenerator housing 33' has been located at a lower level than the manifold 35' to the cylinder 30'.

I claim:

1. A hot gas engine heater head in which an oscillating flow of gaseous working medium is heated and circulated between a cylinder and a regenerator cavity surrounding said cylinder, said heater head comprising:

a plurality of tubes, each being connected at one end to a first manifold providing entrance to said cylinder and at the other end to a second manifold providing entrance to said regenerator cavity;

said first manifold being connected to said cylinder top via a central duct;

said second manifold being connected with said regenerator cavity via a second duct surrounding said central duct and having an annular cross section.

2. A heater head according to claim 1, wherein said ducts are coaxially arranged relative to said cylinder.

3. A heater head according to claim 2, wherein said first and second manifolds are located substantially in planes perpendicular to the axis of the cylinder and at two different levels.

4. A heater head according to claim 1, wherein said cylinder includes a sleeve disposed concentrically within a regenerator housing and defining said regenerator cavity therebetween.

5. A heater head according to claim 4, wherein said first and second manifolds and said ducts are defined within a manifold housing, said manifold housing having a pair of concentric necks, one of which is connected in an opening in said regenerator housing, and the other of which is connected to an opening in said cylinder.

6. A heater head defined in claim 5, wherein said central duct is defined within said other neck, and said annular duct is defined between said necks.

7. A heater head for a hot gas engine, comprising:

a cylinder containing a reciprocating piston;

a regenerator housing surrounding said cylinder and defining therebetween an annular regenerator cavity;

first means defining an opening in the top of said regenerator housing;

second means defining an opening in the top of said cylinder;

a unitary manifold housing having a first portion which engages said first means with a hermetic seal and a second portion which engages said second means with a tight seal;

a first manifold in said manifold housing communicating through a first duct with said regenerator cavity;

a second manifold in said manifold housing communicating through a second duct with said cylinder;

said second duct being concentrically disposed within said first duct.

* * * * *